United States Patent [19]

Kumar et al.

[11] Patent Number: 4,464,206

[45] Date of Patent: Aug. 7, 1984

[54] WROUGHT P/M PROCESSING FOR PREALLOYED POWDER

[75] Inventors: Prabhat Kumar; Ronald D. Rivers, both of Kokomo, Ind.; Anthony J. Hickl, Wyomissing, Pa.

[73] Assignee: Cabot Corporation, Kokomo, Ind.

[21] Appl. No.: 555,315

[22] Filed: Nov. 25, 1983

[51] Int. Cl.[3] ..... B22F 1/00; B22F 3/16

[52] U.S. Cl. ..... 148/11.5 P; 419/28; 419/30; 419/33; 75/246

[58] Field of Search ..... 148/11.5 P; 75/0.5 R, 75/246; 419/28, 30, 33

[56] References Cited

U.S. PATENT DOCUMENTS

| | | | |
|---|---|---|---|
| 2,329,698 | 9/1943 | Dean | 75/22 |
| 2,746,741 | 1/1954 | Naeser | 266/5 |
| 3,052,976 | 9/1962 | Rennback | 29/420 |
| 3,122,434 | 2/1964 | Reed et al. | 75/214 |
| 3,270,409 | 9/1966 | Grant | 29/420.5 |
| 3,436,802 | 4/1969 | Cohen | 29/420.5 |
| 3,462,260 | 8/1969 | Thafvelin et al. | 419/30 |
| 3,498,782 | 3/1970 | Spink et al. | 419/30 |
| 3,744,993 | 7/1973 | Matt | 75/213 |
| 3,775,101 | 11/1973 | Freche | 75/213 |
| 3,810,757 | 5/1974 | Andrews | 29/420.5 |
| 3,827,921 | 8/1974 | Sherby et al. | 148/11.5 P |
| 3,834,004 | 9/1974 | Ayers | 29/420.5 |
| 3,975,193 | 8/1976 | Nayar | 75/211 |
| 3,976,482 | 8/1976 | Larson | 419/30 |
| 4,045,857 | 9/1977 | Suzuki | 29/420 |
| 4,069,044 | 1/1978 | Mocarski | 75/243 |
| 4,110,131 | 8/1978 | Gessinger | 148/11.5 N |
| 4,343,650 | 8/1982 | Rivers | 75/213 |

*Primary Examiner*—W. Stallard

*Attorney, Agent, or Firm*—Jack Schuman; Joseph J. Phillips; Robert F. Dropkin

[57] ABSTRACT

A process for producing a wrought product of improved ductility from substantially noncompactible prealloyed metal powder. The process comprises the steps of: comminuting substantially noncompactible prealloyed metal powder so as to flatten the particles thereof; heating the comminuted particles of metal powder at an elevated temperature, the particles adhering and forming a mass during heating; crushing the mass of metal powder; compacting the crushed mass of metal powder; sintering the metal powder; and hot working the metal powder into a wrought product. The wrought product has a chemistry which is substantially the same, with the exception of carbon and certain residuals, as the chemistry of the prealloyed powder.

10 Claims, No Drawings

WROUGHT P/M PROCESSING FOR PREALLOYED POWDER

The present invention relates to a process for producing a wrought product from metal powder, and more particularly, to a process for producing a wrought product from substantially noncompactible prealloyed metal powder.

Principles of powder metallurgy have been used for producing wrought shapes of metals and alloys. Compactible metal powders have been pressed, sintered and hot worked. Satisfactory product has been obtained.

Substantially noncompactible metal powder; i.e., powder which is substantially noncompressible at room temperature at a pressure of 35,000 psi, has not, on the other hand, yielded a satisfactory product when pressed, sintered and hot worked. A product of insufficient ductility has been produced.

Through the present invention there is provided a process for producing a wrought product of improved ductility from substantially noncompactible prealloyed metal powder. Powder is not only pressed, sintered and hot worked, but also comminuted, heated and crushed.

A process wherein metal powder is comminuted, heated and crushed is disclosed in U.S. Pat. No. 4,343,650. The process of U.S. Pat. No. 4,343,650 is, however, different from that of the present invention. U.S. Pat. No. 4,343,650 is not directed to a process for producing a wrought product and, moreover, specifically calls for the step of blending a soft metal-bearing powder with the comminuted prealloyed powder. The chemistry of the product is therefore substantially different from that of the prealloyed powder. Such is not the case with the present invention.

Other references disclose processes wherein metal powder is heated. These references include U.S. Pat. Nos. 2,329,698; 3,436,802; and 3,744,993. None of them disclose the process of the present invention. Still other references, disclose processes for producing wrought products from metal powder. These references include U.S. Pat. Nos. 2,746,741; 3,052,976; 3,122,434; 3,270,409; 3,775,101; 3,810,757; 3,834,004; 3,975,193; 4,045,857; 4,069,044; and 4,110,131. As with the previously referred to references, none of them disclose the process of the present invention.

It is, accordingly, an object of the present invention to provide a process for producing a wrought product of improved ductility from substantially noncompactible prealloyed metal powder.

The process of the present invention comprises the steps of: comminuting substantially noncompactible prealloyed metal powder so as to flatten the particles thereof; heating the comminuted particles of metal powder at an elevated temperature, the particles adhering and forming a mass during heating; crushing the mass of metal powder; compacting the crushed mass of metal powder; sintering the metal powder; and hot working the metal powder into a wrought product. The wrought product has a chemistry which is substantially the same, with the exception of carbon and certain residuals, as the chemistry of the prealloyed powder. A form of carbon; e.g. graphite, may be added to adjust the chemical composition of the product. The prealloyed powder is generally from the group consisting of cobalt-base, nickel-base and iron-base alloys. The powder is not combined with an organic binder.

Prealloyed powders are comminuted to increase their compressibility. Comminution can be accomplished by any of those methods known to those skilled in the art. Ball milling is presently preferred. The comminuted particles will generally have an average size of less than 10 microns, which in most instances will be less than 5 microns.

The comminuted powders are heated to effect a further increase in compressibility. The temperature to which the powders are heated cannot be precisely set forth as it is dependent upon the type of powder being treated and the duration of the treatment. The temperature must, however, be sufficiently high to cause the particles to adhere and form a mass. A sufficient increase in compressibility is not attained if heating is not at a high enough temperature and/or for a long enough period of time for the particles to adhere. Too high a temperature can, on the other hand, harden the mass to the extent that it is difficult to crush (breakup). Alloys within the scope of the present invention, are generally heated to a temperature in excess of 1800° F. (982° C.), and more often than not to a temperature in excess of 1925° F. (1052° C.). Heating is generally done in a vacuum or a reducing atmosphere; e.g. bydrogen. Crushing can be accomplished by any means known to those skilled in the art.

The crushed powder can be compacted, sintered and hot worked according to any of these processes known to those skilled in the art. Cold isostatic pressing is the preferred means for compacting the powder. Sintering is performed at a temperature and for a time period sufficient to impart a density of at least 85% of theoretical density and preferably at least 90% of theoretical density, to the compacted metal powders. The sintering temperature cannot be precisely set forth as it is dependent upon the type of powder being treated and the duration of the treatment. Alloys within the scope of the present invention are generally sintered at a temperature in excess of 2000° F. (1093° C.). Sintering is generally done in a vacuum or a reducing atmosphere; e.g. hydrogen. Illustrative forms of hot working are forgoing, extrusion, rolling and swaging. The hot worked product will have a density which approaches 100% of theoretical density.

The following examples are illustrative of several aspects of the invention.

EXAMPLE I

Prealloyed metal powder was ball milled for 50 hours so as to flatten the particles thereof (the average particle size was 3.7 microns). The chemistry of the powder, in weight percent, was as follows:

| | |
|---|---|
| Cr 29.2 | Fe 2.4 |
| Mo 0.54 | Mn 0.36 |
| W 4.85 | C 1.12 |
| Ni 2.35 | O 0.05 |
| Si 1.09 | N 0.11 |
| S 0.012 | B 0.004 |
| P <0.004 | Co Balance |

The milled powder was annealed for 2 hours at 2000° F. (1093° C.) in a vacuum. Particles of powder adhered and formed a mass during annealing. The mass was crushed using a jaw crusher and a pulverizer. The crushed powder was cold isostatically pressed at a pressure of 35,000 psi and sintered for 4 hours at 2325° F. (1274° C.) in a vacuum. Pressed and sintered densities were respectively 55 and 98% of theoretical density. The sintered product was 2½ inches in diameter. It was extruded to a diameter of 1 inch at 2250° F. (1232° C.) and hot rolled from 1 inch to 9/16 inch at 2250° F. (1232° C.).

The hot rolled material was tested for 0.2% yield strength, tensile strength, % elongation and % reduction in area. The results of the tests appear hereinbelow in Table I along with comparative data for material of similar chemistry produced by conventional (casting plus working) processing.

TABLE I

| | Mechanical Properties | | | |
|---|---|---|---|---|
| Processing | Y.S. (ksi) | T.S. (ksi) | Elongation (%) | Reduction In Area (%) |
| Conventional | 103–115 | 173–175 | 10.1–11.6 | 9.4–10.8 |
| Invention | 96–99 | 176–178 | 11.9–14.1 | 12.2–14.5 |

The data set forth in Table I clearly shows the improvement in ductility obtained with the processing of the present invention. The attained yield strengths and tensile strengths were more than satisfactory.

EXAMPLE II

Prealloyed metal powder was ball milled for 50 hours so as to flatten the particles thereof (the average particle size was 4.5 microns). The chemistry of the powder, in weight percent, was as follows:

| | |
|---|---|
| Cr 27.8 | Fe 1.57 |
| Mo 5.83 | Mn 0.46 |
| W <0.01 | C 0.22 |
| Ni 2.0 | O 0.03 |
| Si 0.7 | N 0.14 |
| S 0.011 | B <0.007 |
| P <0.005 | Co Balance |

The milled powder was annealed for 1 hour at 2050° F. (1121° C.) in hydrogen. Particles of powder adhered and formed a mass during annealing. The mass was crushed using a jaw crusher and a pulverizer. The crushed powder was cold isostatically pressed at a pressure of 35,000 psi and sintered for 4 hours at 2380° F. (1304° C.) in a vacuum. Pressed and sintered densities were respectively 55 and 92% of theoretical density. The sintered product was 2½ inches in diameter. It was extruded to a diameter of ⅝ inch at 2100° F. (1149° C.) and hot rolled from ⅝ inch to ⅜ inch at 2100° F. (1149° C.).

The hot rolled material was tested for 0.2% yield strength, tensile strength, % elongation and % reduction in area. The results of the tests appear hereinbelow in Table II along with comparative data for material of similar chemistry produced by conventional powder metallurgical processing. The conventionally produced material was canned, extruded and hot rolled. It was not comminuted or annealed.

TABLE II

| | Mechanical Properties | | | |
|---|---|---|---|---|
| Processing | Y.S. (ksi) | T.S. (ksi) | Elongation (%) | Reduction In Area (%) |
| Conventional | 87–108 | 157–164 | 16–26 | 15–25 |
| Invention | 80–85 | 150–151 | 28–34 | 23–28 |

The data set forth in Table II clearly shows the improvement in ductility obtained with the processing of the present invention. The attained yield strengths and tensile strengths were more than satisfactory.

It will be apparent to those skilled in the art that the novel principles of the invention disclosed herein, in connection with specific examples thereof, will suggest various other modifications and applications of the same. It is, accordingly, desired that in construing the breadth of the appended claims, they shall not be limited to the specific examples of the invention described herein.

We claim:

1. In a process for producing a wrought product from metal powder, which process includes the steps of: compacting metal powder; sintering metal powder; and hot working said sintered powder; the improvement comprising the steps of: comminuting substantially non-compactible prealloyed metal powder so as to flatten the particles thereof; heating said comminuted particles of metal powder at an elevated temperature, said particles adhering and forming a mass during heating; crushing said mass of metal powder; compacting said crushed mass of metal powder; sintering said metal powder; and hot working said sintered powder into a wrought product, said wrought product having a chemistry which is substantially the same, with the exception of carbon and certain residuals, as the chemistry of the prealloyed powder.

2. The process according to claim 1, wherein said prealloyed metal powder is from the group consisting of cobalt-base, nickel-base and iron-base alloys.

3. The process according to claim 2, wherein said prealloyed metal powder is a cobalt-base alloy.

4. The process according to claim 1, wherein said comminuted particles of metal powder have an average size of less than 10 microns.

5. The process according to claim 4, wherein said comminuted particles of metal powder have an average size of less than 5 microns.

6. The process according to claim 1, wherein said comminuted particles of metal powder are heated at a temperature of at least 1800° F. (982° C.).

7. The process according to claim 1, wherein said step of comminuting comprises the step of ball milling.

8. The process according to claim 1, wherein said step of compacting comprises the step of cold isostatically pressing.

9. The process according to claim 1, wherein said comminuted particles of metal powder are heated at a temperature of at least 1925° F. (1052° C.).

10. A wrought powder metallurgical product of a cobalt-base, nickel-base or iron-base alloy, made in accordance with the process of claim 1.

* * * * *